United States Patent [19]

Svyatsky

[11] Patent Number: 5,048,814

[45] Date of Patent: Sep. 17, 1991

[54] DOCUMENT ORIENTATION MECHANISM

[75] Inventor: Eduard Svyatsky, Libertyville, Ill.

[73] Assignee: Bell & Howell Company, Evanston, Ill.

[21] Appl. No.: 495,274

[22] Filed: Mar. 16, 1990

[51] Int. Cl.[5] ..... B65H 29/12

[52] U.S. Cl. ..... 271/186; 271/176; 271/291

[58] Field of Search ..... 271/186, 291, 184, 176

[56] References Cited

U.S. PATENT DOCUMENTS

| | | | |
|---|---|---|---|
| 3,735,977 | 5/1973 | Reist | 271/184 |
| 4,078,789 | 3/1978 | Kittredge | 271/186 X |
| 4,699,367 | 10/1987 | Russel | 271/186 X |
| 4,802,665 | 2/1989 | Allio | 271/184 X |
| 4,928,127 | 5/1990 | Stemmle | 271/186 X |

*Primary Examiner*—Richard A. Schacher
*Attorney, Agent, or Firm*—Welsh & Katz, Ltd.

[57] ABSTRACT

A document orientation mechanism is disclosed for reversing the orientation of individual documents delivered from stacks of multiple documents while maintaining a predetermined directional document stream. A predetermined directional stream of documents is fed laterally into the mechanism from an outside source. Inside the mechanism, the documents are removed in a first direction along a first portion of a moving belt, then transferred by a guide to a second portion of the moving belt which is moving in a direction opposite to the first direction, the outer face of the documents being thereby reversed. The documents are then propelled by a third portion of the moving belt out of the laterally disposed mechanism and back into the original predetermined directional document stream.

75 Claims, 1 Drawing Sheet

A
B
A'
B'
50
60
64
10
E
EB
EF
62
63
34
36
16
16a
16b
14
18
40
40a
42
30
38
39
41
12
26
22
24
20
32
28
31
29

DOCUMENT ORIENTATION MECHANISM

BACKGROUND OF THE INVENTION

This invention relates to document and mail handling systems and, more particularly, to systems for orienting and feeding mail and other documents for further processing.

In postal and credit operations, it is desirable to code certain documents and envelopes using a bar code keying and printing module, and to thereafter sort the documents by using a bar code reader and sorter. Since most bar code readers can only read one face of the documents at a time, it is important that the documents fed into the sorter all have the face of the document carrying the bar code facing in a uniform direction.

An efficient means for preparing envelopes and documents for feeding into a document transport means, including a bar code reader and sorter, is to use a dual operator keying and printing station. Optimal floor space is minimized using this arrangement because one operator is placed on either side of the document transport means. The potentiality of a problem arising from this arrangement occurs in that envelopes or documents being fed from the operator station on the left side of the transport means will face in the direction opposite to those envelopes coming from the operator station on the right hand side. The face of the documents streaming from one operator station must therefore be reversed so that the integrated documents from both operators will all face in a uniform direction in order to be readable by a single bar code reader.

A novel system and means for executing document reversal is shown in the present invention. In the known prior art, namely, U.S. Pat. No. 4,119,194 issued to Freeman et al., a single station system and apparatus is disclosed for sorting postage bearing mail based on the location of the postage indicia, utilizing a chute-like receptacle which then ejects and directs mail pieces to separate right and left conveyors, depending upon whether indicia is present adjacent to the right or left edge of the envelope. The conveyors circle and form a closed loop connected to the document transport means.

SUMMARY OF THE INVENTION

The present invention provides a system and mechanism for reversing the direction of the face of a stream of documents moving in a predetermined direction, which may be integrated with another separate document stream for further processing, so that the final integrated document stream has uniform facing when it enters a secondary processing system.

The orienting mechanism of this invention is placed generally perpendicular to a document stream, and it accepts individual documents or serially disposed multiple documents propelled by an outside source in a predetermined direction. It reverses the direction in which the document faces are oriented by moving the documents via a belt having a first portion thereof tangential to and moving in the same predetermined direction. A second portion of the belt is generally perpendicular to the predetermined direction, and means is provided for transferring the documents to a doubled over third portion of the belt moving in the opposite direction, and then causing said documents to be moved generally tangentially to their original predetermined direction and into said document stream with their faces reversed from their original orientation.

The belt may advantageously be arranged over four or more pulleys in a generally V-shaped fashion having the inner or throat portion of the arrangement with the opposed substantially parallel spaced second and third portions of the belt moving in directions opposite each other. Preferably, the first portion of the belt, with which the envelope or document initially makes contact, is tangential to and moves in the same direction as the outside propulsion means for the document stream, and the belt then moves around one of the pulleys into a second or transfer position substantially perpendicular to the document stream. A first automatic sensing element of an integral transfer means is initially moved out of the path of the envelope or document as it follows the belt around the one of pulleys from the first position into the second perpendicular position. When the document has totally moved beyond the first sensing element of the transfer means into the second transfer position, it is juxtaposed relative to the belt and it is contiguous to the parallel third portion of the belt, which having moved around a second pulley, is now moving in the opposite direction relative to the second portion of the belt. The automatic transfer means moves laterally to shift the document away from its juxtaposition relative to the second portion of the belt, and to shift the document into a juxtaposed relation to the oppositely moving third portion of the belt.

The third portion of the belt is then moved around a third pulley forming a fourth portion generally tangential to and moving in the same direction as the main document stream so that the reversed documents may easily return to the original stream.

The output of the orientation mechanism provides a stream of documents facing the reverse direction from the input stream. The output stream of documents reenters the overall stream of documents and may then be integrated with another document stream of the opposite hand so that all documents in the intergrated stream face in a uniform direction. Either one of the single streams or the integrated streams may then be fed directly to a bar code reader or an optical character scanner for sorting, or to a letter postage cancelling apparatus.

An advantage of the instant invention is that the mechanism embodies few movable elements. This simplicity of mechanism contributes heavily to its inherent reliability and smooth operation.

While the orientation mechanism of this invention is useful in postal operations, the invention is also useful in orienting individual or stacked documents, and other flat articles bearing some form of indicia for further processing.

DETAILED DESCRIPTION

Figures 1, 1A, 1B, 2, 3:
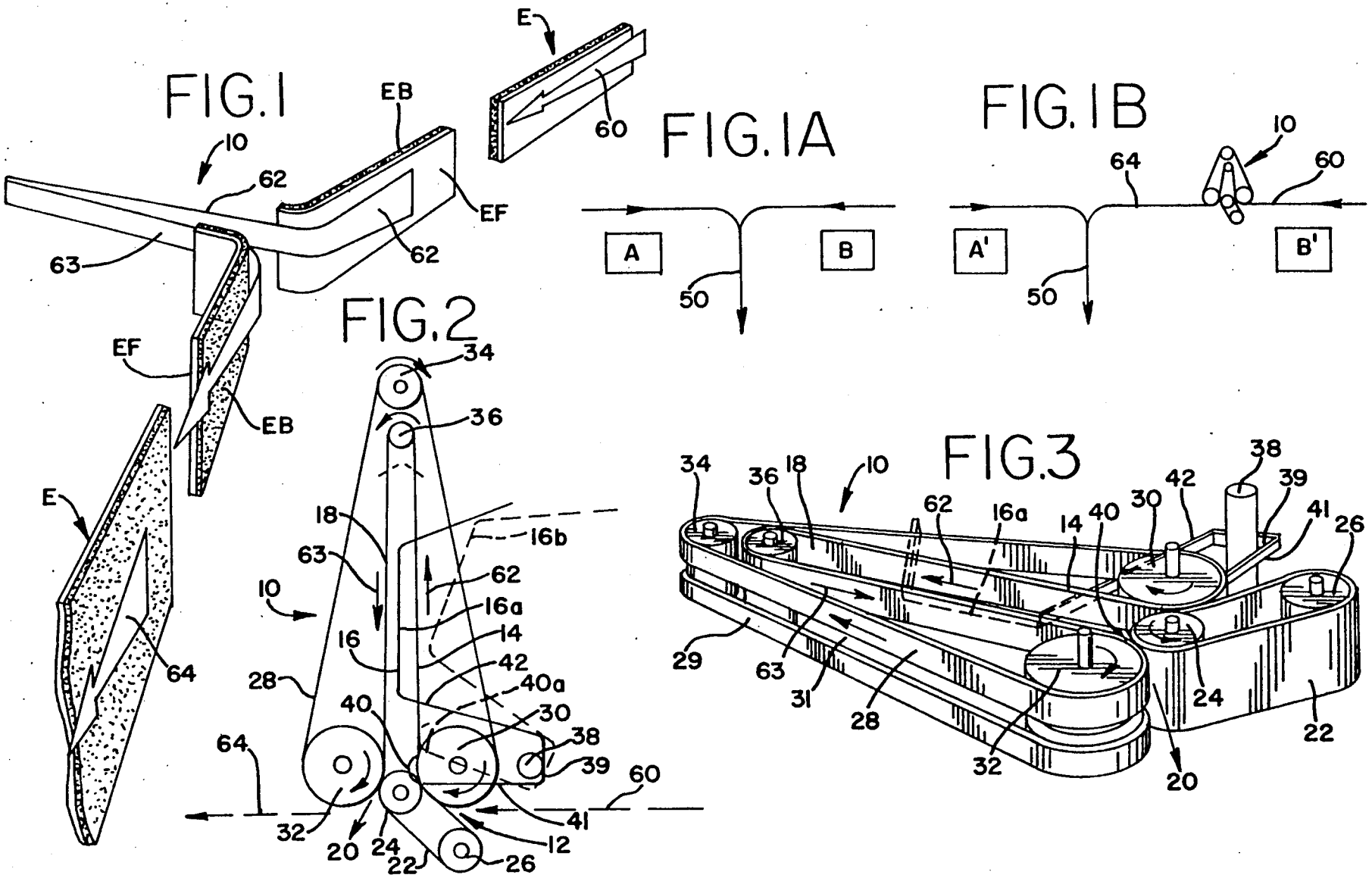
FIG. 1 is a simplified schematic perspective view of the document flow through the document orientation mechanism of the present invention, showing the face reversal of the documents.
FIG. 1A is a schematic plan view of a two operator station arrangement on opposite sides of a document transport mechanism.
FIG. 1B is a schematic view similar to FIG. 1A with the addition of an orienting mechanism of the type contemplated by the present invention.
FIG. 2 is a simplified schematic top plan view of an envelope orientation mechanism including means for reversing the face of documents according to a preferred embodiment of the invention; and, FIG. 3 is a perspective partial view of the document orienting mechanism shown in FIG. 2, with the transfer mechanism now shown for purposes of clarity of illustration.

Where operator keying stations are utilized for purposes of correcting or introducing bar codes on the face of envelopes or documents to assist in the sorting of the same, it has been found that dual operator keying station modules A and B of FIG. 1A can be designed to minimize the floor space required while maintaining a linear envelope flow in transport means 50 from these modules into a bar code sorter, not shown. By placing one operator on either side of the envelope transport means 50, a potential problem occurs. It will be appreciated, as seen in FIG. 1A, that when the front of the envelopes initially face each of the operators, the envelopes from operator station A on the left-hand side of the envelope transport means 50 will face in the opposite direction, when blended, from the envelopes of operator station B on the right-hand side of the envelope transport means 50. In order to eliminate this reverse disposition of the envelopes, a simple but very effective generally V-shaped belt path 10 (envelope orienting means) is used to reverse the direction of the envelope from its initial orientation at the key entry operator station B before merging into the envelope transport means 50, as seen in FIG. 1B.

As can be best seen in FIG. 1, the path of the sequence of envelopes "E" is schematically illustrated by the broad arrow ribbon which is designated 60 as it approaches the orienting mechanism 10, (not fully structurally shown in FIG. 1); the ribbon being designated 62 where the envelope path is inbound within the orienting mechanism 10; being designated 63 where the envelope path is outbound; and being designated 64 where the envelope "E" has re-entered the main stream of envelopes, in a reversed condition, for merging with the envelopes from Station A, so that as the merged envelopes proceed along the transport means 50 toward the bar code reader and sorter, not shown, they will be uniformly oriented. To better illustrate the operation of this device 10, the envelopes "E" in FIG. 1 are shown as a laminate with the back of the envelope being designated "EB" and having a darkened mottled layer. The front of the envelope "E" is designated "EF" and is the clean white layer.

The orienting mechanism 10 consists of a doubled over belt path comprising an upper belt 28 and a lower belt 29 with a gap 31 therebetween, along with the necessary drive and idler pulleys 30, 32 and 36, as shown in FIGS. 2 and 3. The envelope "E" following path 60 (FIG. 2), enters the throat 12 (FIG. 2) into the folded belt path with the inward running part 14 of the upper belt 28, and an equivalent part of the lower belt 29 which is not visible in FIGS. 2 and 3, in contact with one face of the envelope and driving it into the mechanism. The orienting mechanism also includes a spring loaded envelope sensor 40 (FIGS. 2 and 3) that projects inwardly below part 14 of upper belt 28 and into the gap 31 above lower belt 29, not shown. Each envelope "E" when it enters the throat 12, formed by the moving diverter belt 22, moving counterclockwise about sheaves 24 and 26, and tangentially engaging belts 28 and 29 as they pass over, a power actuated, clockwise rotating, drive pulley 30, contacts and deflects sensor 40 in a clockwise direction. (Sheave 24 may be operatively connected to driven pulley 30 by a common motive means transmitting rotation to sheave 24 and pulley 30 from a single power source. The sensor 40 is connected by arm 41 to a perpendicular section 39 (FIGS. 2 and 3) fastened to the counterclockwise spring loaded rotatable shaft or pivot post 38. Extending inwardly towards the belt portion 14 is an elongated arm 42 that supports a deflector guide arm 16 (FIG. 2). Arm 16 is normally below belt portion 14, as shown in FIG. 2 as the solid line **16*a*, and it moves away from its normal solid-line 16*a* position when sensor 40 is deflected by an envelope to its deflected position, shown by broken lines as 40*a*, to thereby pivot the arm 16 to the retracted position shown by broken lines as 16*b* (FIG. 2). When the trailing edge of the envelope "E" clears the input roller belt nip, between rollers 24 and 30, it releases the envelope sensor 40 (shown in FIG. 2 as a mechanical wire-form sensor) which then causes the deflector guide arm 16 (which is moved by the spring-loaded pivot post or shaft 38) to press the envelope against the outward running part 18 of the belt 28 and against an equivalent outward running part of the lower belt 29, which is not visible in FIGS. 2 and 3. This causes the belt part 18 and the equivalent part of belt 29, which now contact the opposite face of the envelope, to drive the envelope in the opposite direction from before, accomplishing the required reorientation. The envelope will be ejected out of the exit throat 20, between belt pulleys 24 and 32, and will contact direction control means, not shown, which will divert the envelopes into the desired path 64 (FIG. 2) for movement to the point of merger with the envelopes from operator station A′ along the path of transport belts 50 (FIG. 1B) leading to the bar code reader and sorter mechanism (not shown). The direction control means or output means may include at least one belt arranged on at least two pulleys in a structure substantially identical to the input diverter belt 22 on sheaves 24 and 26**. Preferably, the output means is powered by and is part of the means for moving the documents in the predetermined overall directional path.

The simplicity of the mechanism is remarkable and contributes heavily to its inherent reliability and smooth operation over extended periods of continuous usage. It is to be noted that the wire-form structure comprising wire elements 40, 41, 39, 41 and 16 in FIG. 2 is shown to comprise equivalent elements of rectangular bars in FIG. 3, for purposes of illustrating equivalency. Cylindrical rod elements could also be used. While other modifications to the inventive mechanism will be apparent to those skilled in the art, it is the intent of the inventor to not be limited other than in the claims attached hereto.

I claim:

1. A document orientation mechanism including means for reversing the face of documents moving in a predetermined path which does not alter the overall direction of said predetermined path of said documents, including, input means for feeding a sequence of documents into said mechanism at a document inlet;

first directional means in said mechanism for first moving documents in the same direction as said predetermined path of said sequence of documents, and for then moving documents in a first transverse path away from said predetermined path;

second directional means positioned in opposition to said first directional means for moving documents in a second transverse path having a reverse direction from the movement of said first transverse path;

guide means for transferring each document of said sequence from said first directional means first transverse path to said second directional means;

sensor means for signaling said guide means to react for document transfer upon completion of each document input into said first transverse path;

output means for returning said documents sequentially to said overall direction of said predetermined path; and, rotatable pivot means mounting said guide means and said sensor means for pivotable rotation back and forth around a pivot axis proximate to said first directional means as each document enters and passes through said document inlet.

2. A document orientation mechanism as claimed in claim 1 in which said first and second directional means includes a V-shaped belt path.

3. A document orientation mechanism as claimed in claim 2 wherein said V-shaped belt path includes a doubled over belt path.

4. A document orientation mechanism as claimed in claim 3 wherein said doubled over belt path includes an inward running belt part and an outward running belt part.

5. A document orientation mechanism as claimed in claim 4 wherein said doubled over belt path includes at least one belt arranged on a plurality of spaced pulleys.

6. A document orientation mechanism as claimed in claim 5 in which said at least one belt is arranged on at least one power driven pulley and a plurality of idler pulleys so that said inward running belt part faces and is substantially parallel to said outward running belt part.

7. A document orientation mechanism as claimed in claim 1 in which said input means includes belt means arranged on two or more pulleys.

8. A document orientation mechanism as claimed in claim 1 wherein said input means is adjacent to and intersectable with said first directional means.

9. A document orientation mechanism as claimed in claim 1 wherein said input means is movably located to intercept said overall predetermined directional path of said documents.

10. A document orientation mechanism as claimed in claim 1 in which said input means is adapted to be moved into contact with said documents, with said input means moving in the same direction as said first predetermined directional means.

11. A document orientation mechanism as claimed in claim 9 in which said input means is separate and independent from said means for moving said documents in said overall predetermined directional path.

12. A document orientation mechanism as claimed in claim 9 wherein said input means is connected to said means for moving said documents in said overall predetermined directional path.

13. A document orientation mechanism as claimed in claim 1 wherein said guide means pivots around an axis adjacently spaced from and parallel to the axis of drive means for said first directional means.

14. A document orientation mechanism as claimed in claim 13 in which said guide means when pivoted extends over said first directional means.

15. A document orientation mechanism as claimed in claim 1 wherein said sensor means activates said guide means when the trailing edge of said document entering said mechanism clears said sensor.

16. A document orientation mechanism as claimed in claim 1 in which said sensor means includes a mechanical wire-form.

17. A document orientation mechanism as claimed in claim 16 wherein said sensor means is attached to said guide means.

18. A document orientation mechanism as claimed in claim 1 wherein said output means is adjacent to said second directional means.

19. A document orientation mechanism as claimed in claim 1 wherein said output means includes at least one belt arranged on at least two pulleys.

20. A document orientation mechanism as claimed in claim 7 wherein said output means includes a structure substantially identical to said input means.

21. A document orientation mechanism as claimed in claim 1 wherein said output means is located substantially in said overall predetermined directional path of said documents.

22. A document orientation mechanism as claimed in claim 1 wherein said output means is in contact with and is moving in the same direction as said second directional means.

23. A document orientation mechanism as claimed in claim 1 wherein said output means is separate from said means for moving the documents in said predetermined overall directional path.

24. A document orientation mechanism as claimed in claim 1 wherein said output means is powered by and is part of said means for moving said documents in said predetermined overall directional path.

25. A document orientation mechanism as claimed in claim 20 wherein said output means is separate from said means for moving the documents in said overall directional path.

26. A document orientation mechanism as claimed in claim 1 wherein said pivot axis is proximate to a power activated drive member of said first directional means.

27. A document orientation mechanism as claimed in claim 26 wherein said power actuated drive member is a power actuated drive pulley and said first directional means includes a driveable belt mounted on said drive pulley.

28. A document orientation mechanism as claimed in claim 1 wherein said first directional means comprises at least one belt moving in the same direction as said predetermined path and then moving transversely away from said predetermined path, and said second directional means comprises said at least one belt moving transversely toward said predetermined path.

29. A document orientation mechanism as claimed in claim 28 wherein said second directional means further includes said at least one belt moving in the same direction as said predetermined path.

30. A document orientation mechanism as claimed in claim 1 wherein said first directional means comprises first and second belts, with a gap therebetween, moving in the same direction as said predetermined path and then moving transversely away from said predetermined path, and said second directional means comprises said first and second belts moving transversely toward said predetermined path.

31. A document orientation mechanism as claimed in claim 30 wherein said second directional means further includes said first and second belts moving in the same direction as said predetermined path.

32. A document orientation mechanism as claimed in claim 30 wherein said guide means and said sensor means pivotably rotate back and forth within said gap.

33. A document orientation mechanism including means for reversing the face of documents moving in a predetermined directional path, said reversing means being positioned laterally of but not altering said overall predetermined directional path of said documents, including input means for feeding a sequence of documents into said mechanism at a document inlet;

first directional means, for first moving documents in the same direction as said predetermined path of said sequence of documents, and then moving documents laterally away from said predetermined path;

second directional means opposite said first directional means for moving documents in a lateral direction reverse from the from the lateral direction of said first directional means;

guide means for transferring said documents from said first directional means to said second directional means;

sensor means for signaling said guide means to move each document from the first directional means to the second directional means upon completion of each document input;

a wire-form structure comprising said sensor means and said guide means as integral portions thereof; and, a spring-loaded rotatable post element pivotally mounting said wire-form structure and having a pivot axis substantially parallel to an axis of said first directional means, for pivotally rotating said wire-form structure back and forth as each document enters and passes through said document inlet.

34. A document orientation mechanism as claimed in claim 33 wherein said first and second directional means includes a V-shaped belt path.

35. A document orientation mechanism as claimed in claim 34 wherein said V-shaped belt path includes a doubled over belt path in opposition.

36. A document orientation mechanism as claimed in claim 35 wherein said doubled over belt path includes an inward running belt part and an outward running belt part.

37. A document orientation mechanism as claimed in claim 36 wherein said doubled over belt path includes at least one belt arranged on a plurality of spaced pulleys.

38. A document orientation mechanism as claimed in claim 37 wherein said at least one belt is arranged on at least one power driven pulley and plurality of idler pulleys so that said inward running belt part faces and is substantially parallel to and in spaced relation to said outward running belt part.

39. A document orientation mechanism as claimed in claim 33 wherein said input means includes belt means arranged on at least one pulley.

40. A document orientation mechanism as claimed in claim 33 wherein said input means is adjacent to and intersectable with said first directional means.

41. A document orientation mechanism as claimed in claim 33 wherein said input means is movably located to intercept said overall predetermined directional path of said documents.

42. A document orientation mechanism as claimed in claim 33 wherein said input means is adapted to be moved into contact with said documents, said input means moving in the same direction as said first predetermined directional means.

43. A document orientation mechanism as claimed in claim 41 wherein said input means is separate and independent from said means for moving said documents in said overall predetermined directional path.

44. A document orientation mechanism as claimed in claim 41 wherein said input means is connected to said means for moving said documents in said overall predetermined directional path.

45. A document orientation mechanism as claimed in claim 33 wherein said guide means pivots around an axis adjacently spaced from and parallel to the axis of drive means for said first directional means.

46. A document orientation mechanism as claimed in claim 45 wherein said guide means is spring loaded and normally extends over and blocks contact by said document with said first directional means.

47. A document orientation mechanism as claimed in claim 46 wherein when said document contacts said sensor said guide means is pivoted out of the way and a first face of said document is permitted to be driven by and follows the path of said first directional means.

48. A document orientation mechanism as claimed in claim 47 wherein said documents include an entering edge and a trailing edge, said sensor means activating said spring loaded guide means when the trailing edge of said document entering said mechanism clears said sensor, said activated guide means pivoting into an overlying position relative to said first directional means thereby dislodging said document therefrom and forcing a second face of said document into engagement with and control by said reversely moving second directional means.

49. A document orientation mechanism as claimed in claim 33 wherein said first directional means axis is the axis of a power actuated drive pulley and said first directional means includes a driveable belt mounted on said drive pulley.

50. A document orientation mechanism as claimed in claim 33 wherein said first directional means comprises at least one belt moving in the same direction as said predetermined path and then moving laterally away from said predetermined path, and said second directional means comprises said at least one belt moving laterally toward said predetermined path.

51. A document orientation mechanism as claimed in claim 50 wherein said second directional means further includes said at least one belt moving in the same direction as said predetermined path after moving toward said predetermined path.

52. A document orientation mechanism as claimed in claim 33 wherein said first directional means comprises first and second belts, with a gap therebetween, moving in the same direction as said predetermined path and then moving laterally away from said predetermined path, and said second directional means comprises said first and second belts moving laterally toward said predetermined path.

53. A document orientation mechanism as claimed in claim 52 wherein said second directional means further includes said first and second belts moving in the same direction as said predetermined path after moving toward said predetermined path.

54. A document orientation mechanism as claimed in claim 52 wherein said guide means and said sensor means pivotably rotate back and forth within said gap.

55. A document orientation mechanism including means for reversing the face of documents moving in a predetermined path which does not alter the overall direction of said predetermined path of said documents, including, input means for feeding documents into said mechanism;

first directional means in said mechanism, first moving in the same direction as said predetermined path of said documents, and then moving documents in a transverse direction away from said path;

second directional means positioned in opposition to said first directional means for moving in a reverse direction from said transverse movement of said first directional means;

guide means for transferring each document from said first directional means to said second directional means;

sensor means for signaling said guide means to react for document transfer upon completion of each document input;

output means for returning said documents to said overall direction of said predetermined path; and, rotatable pivot means mounting said guide means and said sensor means for pivotable rotation back and forth around a pivot axis proximate to a power actuated drive member of said first directional means.

56. A document orientation mechanism as claimed in claim 55 wherein said power actuated drive member is a power actuated drive pulley and said first directional means includes a driveable belt mounted on said drive pulley.

57. A document orientation mechanism as claimed in claim 55 wherein said first directional means comprises at least one belt moving in the same direction as said predetermined path and then moving transversely away from said predetermined path, and said second directional means comprises said at least one belt moving transversely toward said predetermined path.

58. A document orientation mechanism as claimed in claim 57 wherein said second directional means further includes said at least one belt moving in the same direction as said predetermined path after moving toward said predetermined path.

59. A document orientation mechanism as claimed in claim 55 wherein said first directional means comprises first and second belts, with a gap therebetween, moving in the same direction as said predetermined path and then moving transversely away from said predetermined path, and said second directional means comprises said first and second belts moving transversely toward said predetermined path.

60. A document orientation mechanism as claimed in claim 59 wherein said second directional means further includes said first and second belts moving in the same direction as said predetermined path.

61. A document orientation mechanism as claimed in claim 59 wherein said guide means and said sensor means pivotably rotate back and forth within said gap.

62. A document orientation mechanism including means for reversing the face of documents moving in a predetermined directional path, said reversing means being positioned laterally of but not altering said overall predetermined directional path of said documents, including input means for feeding documents into said mechanism;

first directional means moving in the same direction as said predetermined path of said documents;

second directional means opposite said first directional means and moving in a direction reverse from the movement of said first directional means;

guide means for transferring said documents from said first directional means to said second directional means;

sensor means for signaling said guide means to move upon completion of each document input;

a wire-form element comprising said sensor means and said guide means as integral portions thereof; and, a spring-loaded rotatable post element pivotally mounting said wire-form structure and having a pivot axis substantially parallel to the axis of a drive means for said first directional means.

63. A document orientation mechanism as claimed in claim 62 wherein said first directional means comprises at least one belt moving in the same direction as said predetermined path and then moving transversely away from said predetermined path, and said second directional means comprises said at least one belt moving transversely toward said predetermined path.

64. A document orientation mechanism as claimed in claim 63 wherein said second directional means further includes said at least one belt moving in the same direction as said predetermined path after moving toward said predetermined path.

65. A document orientation mechanism as claimed in claim 62 wherein said first directional means comprises first and second belts, with a gap therebetween, moving in the same direction as said predetermined path and then moving transversely away from said predetermined path, and said second directional means comprises said first and second belts moving transversely toward said predetermined path.

66. A document orientation mechanism as claimed in claim 65 wherein said second directional means further includes said first and second belts moving in the same direction as said predetermined path.

67. A document orientation mechanism as claimed in claim 65 wherein said guide means and said sensor means pivotably rotate back and forth within said gap.

68. A document orientation mechanism including means for reversing the face of documents moving in a predetermined path which does not alter the overall direction of said predetermined path of said documents, including, input means for feeding documents from said predetermined path into said mechanism;

first directional means in said mechanism, first moving in the same direction as said predetermined path of said documents, and then moving in a transverse direction away from said path; said first directional means including first and second belts, with a gap therebetween, moving in the same direction as said predetermined path and then moving transversely away from said predetermined path;

second directional means positioned in opposition to said first directional means and moving in a reverse direction from said transverse movement of said first directional means, said second directional means including said first and second belts moving transversely toward said predetermined path;

guide means for transferring each document from said first directional means to said second directional means by moving back and forth within said gap in said first directional means within said transverse moving portion;

sensor means for signaling said guide means to react for document transfer upon completion of each document input; and, output means for returning said documents to said overall direction of said predetermined path.

69. A document orientation mechanism as claimed in claim 68 wherein said second directional means further includes a gap between said first and second belts.

70. A document orientation mechanism as claimed in claim 68 wherein said second directional means further includes said first and second belts moving in the same direction as said predetermined path after moving transversely toward said predetermined path.

71. A document orientation mechanism as claimed in claim 68 wherein said guide means and said sensor means pivotably rotate back and forth within said gap in said first directional means.

72. A document orientation mechanism including means for reversing the face of documents moving in a predetermined directional path, said reversing means being positioned laterally of but not altering said overall predetermined directional path of said documents, including input means for feeding documents from said predetermined path into said mechanism;

first directional means moving in the same direction as said predetermined path of said documents, said first directional means including first and second moving belts with a gap therebetween;

second directional means opposite said first directional means and moving in a direction reverse from the movement of said first directional means, said second directional means including said first and second belts moving in said reverse direction;

guide means for transferring said documents from said first directional means to said second directional means by moving through said gap in said first directional means;

sensor means for signaling said guide means to move through said gap upon completion of each document input; and, means moving documents from said second directional means back into said predetermined path.

73. A document orientation mechanism as claimed in claim 72 wherein said second directional means comprises a gap between said first and second belts.

74. A document orientation mechanism as claimed in claim 73 wherein said second directional means further includes said first and second belts moving in the same direction as said predetermined path.

75. A document orientation mechanism as claimed in claim 73 wherein said guide means and said sensor means pivotably rotate back and forth within said gap in said first directional means.

* * * * *

UNITED STATES PATENT AND TRADEMARK OFFICE

CERTIFICATE OF CORRECTION

PATENT NO. : 5,048,814

DATED : September 17, 1991

INVENTOR(S) : Eduard Svyatsky

It is certified that error appears in the above-identified patent and that said Letters Patent is hereby corrected as shown below:

On the title page, In the Abstract, line 7, delete "removed" and insert --moved--.

Column 2, line 68, after "mechanism", insert --,--;

Column 3, line 54, after "32", insert --, 34--;

Column 3, line 55, after ""E"", insert --,--;

Column 3, line 63, after "28", insert --,--;

Column 4, line 5, after "source.", insert --)--;

Column 4, line 54, delete "in" and insert --by--; and

Signed and Sealed this

Sixth Day of April, 1993

*Attest:*

STEPHEN G. KUNIN

*Attesting Officer*

*Acting Commissioner of Patents and Trademarks*